United States Patent [19]

Seider

[11] 4,043,743

[45] Aug. 23, 1977

[54] COMBUSTION CONTROL SYSTEM

[75] Inventor: Seymour Seider, Hewlett Harbor, N.Y.

[73] Assignee: B.S.C. Industries Corporation, Hewlett Harbor, N.Y.

[21] Appl. No.: 712,549

[22] Filed: Aug. 9, 1976

[51] Int. Cl.[2] ..... F23H 5/08

[52] U.S. Cl. ..... 431/76; 236/15 E; 431/12; 431/90; 431/79

[58] Field of Search ..... 431/76, 79, 12, 90, 431/2; 250/215; 236/15 E

[56] References Cited

U.S. PATENT DOCUMENTS

| | | | |
|---|---|---|---|
| 3,701,622 | 10/1972 | Ducasse | 431/76 |
| 3,723,047 | 3/1973 | DeLivois | 431/76 |
| 3,814,570 | 6/1974 | Guigues et al. | 431/76 |

*Primary Examiner*—Edward G. Favors
*Attorney, Agent, or Firm*—Roberts & Cohen

[57] ABSTRACT

A combustion control system is operated based on the detection of smoke density. A photoelectric device measures the intensity of light directed through the smoke by a lamp in order to measure the smoke density. This measurement is employed to control fuel and/or air supply or the like. To provide a standard reference, light is directed from the lamp through an alternate path not affected by the smoke to the photoelectric device. A shutter mechanism alternately exposes the photoelectric device to light passing through or circumventing the smoke. The photoelectric measurement is compared with a standard and the comparison is used to adjust circuitry connected to the photoelectric device to stabilize the effects of the latter. A continuous monitoring of the adjustment is carried out to determine when an acceptable range of adjustment has been exceeded. A smoke density amplifier is employed to increase effectiveness.

20 Claims, 3 Drawing Figures

COMBUSTION CONTROL SYSTEM

FIELD OF INVENTION

This invention relates to the automatic maintenance of optimum efficiency of combustion in furnaces and the like and more particularly to devices in which fuel and/or air supplies and the like are automatically controlled in accordance with smoke density.

BACKGROUND OF INVENTION

In my prior U.S. Pat. No. 3,861,855, there is disclosed a furnace having an automatic control of the efficiency of combustion. This furnace has a combustion chamber from which smoke, produced incidentally to combustion, is evacuated via a flue. A smoke density measuring apparatus is operatively associated with the flue. This apparatus includes a lamp directing light through the smoke and a photoelectric cell which responds to the strength of the light which has passed through the smoke.

The response of the photoelectric cell is employed in an electrical circuit to operate a motor or other such electromechanical device which, in turn, controls different combustion controlling elements such as, for example, fuel valves, air valves, dampers and so forth. The response of the photoelectric cell is more specifically utilized by placing the cell in series with a variable resistor or potentiometer to form in effect a voltage divider such that the junction between the photoelectric cell and potentiometer presents a voltage signal representative of smoke density. This signal is processed and used in the control of a motor which operates the aforesaid elements.

The use of the afore-noted potentiometer is to permit adjustment of the voltage divider arrangement to select a no-smoke or preferred smoke level. This assumes, however, constant conditions relative to the lamp and photoelectric cells which constant conditions do not in fact generally exist.

SUMMARY OF THE INVENTION

It has been found that if the junction point voltage is stabilized to a constant reference level, zero volts in a preferred case, then the operation of the previously described mechanism is appreciably improved.

The technique used and described herein provides an uninterrupted auxiliary light path for a "test" period, during which period the output signal of the photocell is used to operate a motor driven potentiometer in such a way as to bring the junction point towards or to zero with respect to system ground. The remainder of the cycle, referred to as the "operate" period, then operates the mechanism as described in U.S. Pat. No. 3,861,855 or in my earlier filed U.S. application Ser. No. 524,462, filed Nov. 18, 1974 now Pat. No. 3,973,898.

During the "test" period, should the junction point voltage be other than zero, the error voltage is processed by circuitry hereinafter described so as to operate clockwise and counter-clockwise relays, and rotate a motor-driven potentiometer in the appropriate direction to bring the junction point back to zero. The circuitry also provides the means to time the cycles and to operate a shutter mechanism which diverts the light path from the operating to the test paths at the appropriate time in each cycle.

The exciter lamp of the basic apparatus with the associated mechanical shutter mechanism of the invention under instruction from the control system, sends light to the photo-cell through a path which exposes the beam to flue gas passing through the boiler flue pipe. This beam is obscured partially in proportion to the density of the flue gas. As the light that is impinging on the photocell is thus varying, the output of the photocell under this "operating" condition is a varying analog signal. This analog signal is then processed as described in U.S. Pat. No. 3,861,855 finally driving the control motor in such a manner as to achieve the combustion condition desired.

In a second cycle, the exciter lamp, with the shutter having moved to a second position under instruction from the control system, now sends its light to the photocell through a second path which remains clear and unobstructed at all times. Since this light remains constant as it impinges on the photocell, the output of the photocell during this "test" condition is a constant signal.

The comparator circuits of the control system use this constant "test" signal to adjust and calibrate the input voltages to the control system so as to eliminate errors introduced by drift in the various components for whatever reason.

It is an object of the invention to provide for improved control of combustion.

Another object of the invention is to provide improved combustion control apparatus.

Still another object of the invention is to provide means for the continuous adjustment of control signals and/or the reference from which control signals are derived.

To achieve the above and other objects of the invention, there is provided a combustion control apparatus comprising combustion means producing smoke incidental to the burning of fuel, combustion control means for controlling combustion in said combustion means as a result of which the density of said smoke is varied, smoke exhaust means defining a path along which said smoke is evacuated, adjustable electrical circuit means operating said control means, a radiation source, detection means for detecting said radiation, and further means for guiding said radiation through and around the path along which said smoke is evacuated, and for adjusting said electrical circuit means to provide a continuously adjustable reference against which measurements of smoke density are made for controlling said combination, the measurements of smoke density being made by said detection means in accordance with the radiation being guided through said path and the adjustable reference being provided in accordance with the radiation being guided around said path.

According to a feature of the invention, said further means includes means for cyclically enabling said detection means to detect, alternately, radiation guided through and around said path.

According to another feature, a means is provided for amplifying the density of the smoke through which the radiation is guided.

According to still another feature, there is provided a means for indicating when a range of adjustment of said reference has been exceeded.

In accordance with one aspect of the invention, said radiation source may be a source of light and said detecting means may be a photoelectric means. Said further means may include an optical fibre bundle for guiding the radiation around said path.

According to one embodiment of the invention, said electrical circuit means may include a potentiometer coupled to said detection means and said further means may include a potentiometer coupled to the first said potentiometer and electromechanical means for operating the second said potentiometer.

According to a preferred embodiment of the invention, said further means may include shutter means for selectively and alternately intercepting the radiation guided through and around said path so that said detection means responds alternately to radiation guided through or around said path.

According to another feature of the invention, said further means may include sequential timer means alternately generating operating and test periods and adapted for controlling said shutter means.

According to still another feature of the invention, said further means may include mirror means adjacent said source and guiding part of the radiation to said optical fibre bundle and part of the radiation through said path, and gating means coupled to said counter for indicating operating and test periods.

According to another aspect of the invention, there is a junction between said detection means and the first said potentiometer, said further means including comparator means comparing the voltage at said junction with a reference voltage and generating digital signals indicating whether the voltage at said junction is greater or less than said reference voltage.

According to still another aspect of the invention, there is provided a flip flop controlled by the aforesaid comparator means and controls coupled to said flip flop and operated thereby to cause said electromechanical means to operate selectively in opposite directions.

According to still another feature of the invention, said further means may include a further potentiometer including a wiper, said electromechanical means driving said wiper and comparator means for comparing voltages derived by said wiper with range limit voltages to determine when the latter have been exceeded. Furthermore, the latter said comparator means may operate to block said electromechanical means.

According to another aspect of the invention, there is provided a combustion control method which comprises transmitting radiation through and around smoke generated by said combustion, generating control signals in a circuit in accordance with the strength of the radiation passing through said smoke, adjusting said circuit in accordance with the strength of the radiation passing around the smoke thereby to adjust the control signals, and adjusting the combustion with the control signals.

According to a particularly advantageous embodiment, the radiation passing through and around the smoke is detected sequentially in sequential cycles. Moreover, the circuit may be adjusted in a limited fashion within a limited range.

The above and other objects, features and advantages of the invention will be found in the following detailed description as illustrated in the accompanying drawing.

DETAILED DESCRIPTION

In the preferred embodiment of the invention, the apparatus works in cycles including operating and test parts. In the operating part of the cycle, the mechanical shutter directs light through the flue pipe. In the test part of the cycle, the mechanical shutter directs light through a second path which is clear and unobstructed. This may be done, for example, by using an optical fibre "light pipe", an optical periscope type of arrangement, or any other device or system to direct the light from the exciter lamp around any physical obstacle that may be in the way of the photocell. At least two possible sources of error due to drift variations are eliminated.

The output of the photocell and its resistor network, as measured at the junction point, is fed, for example, to the control system described in U.S. Pat. No. 3,861,855, when in the "operate" condition. In the "test" condition, the signal from the junction point is fed to a comparator where it is compared to ground or zero voltage. If the voltage at the junction point is not zero, then an error signal is generated. This error signal is fed into a clockwise/counter-clockwise control system to generate a signal which is fed to an auto-compensator potentiometer motor. The motor will then move a potentiometer in a direction to bring the junction point voltage back to zero, eliminating the error voltage. This insures that the control system always starts with a zero voltage at the junction point at the start of each "operate" cycle, hence eliminating all error due to drift in the system at this point. It has been found that drift in the system beyond this point is not of a significant value.

A sequential timer times the "operate" and "test" periods. It operates the mechanical shutter and switches the comparator and CW and CCW control systems during the "test" period of the cycle. A typical period would be 6 seconds for "test" and 3 minutes for "operate". These values are not critical and may be varied widely.

Figure 1:
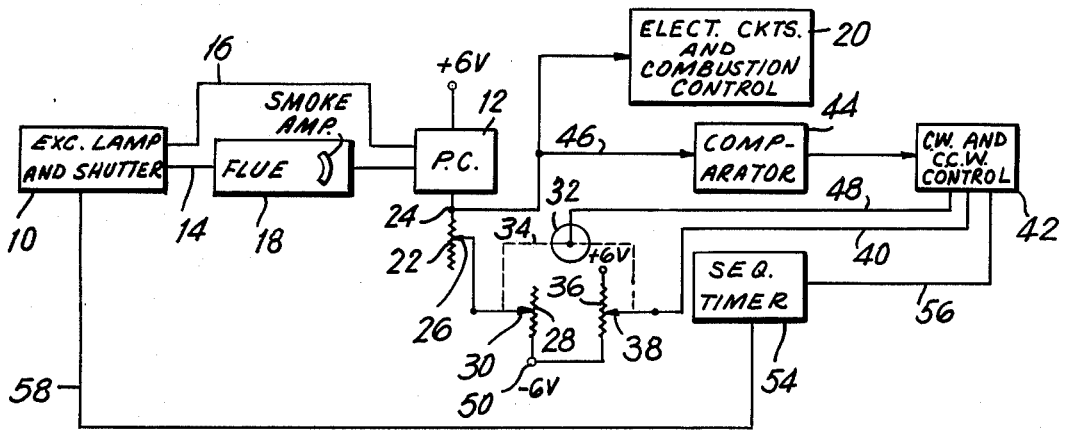
FIG. 1 diagrammatically illustrates a combustion control provided in accordance with the invention.

Referring next to FIG. 1, there is seen the exciter lamp and shutter arrangement which is indicated generally at 10. A photoelectric cell is indicated at 12. There are two optical paths between the exciter lamp and photoelectric cell, these paths being indicated at 14 and 16. The path 14 leads through the flue indicated at 18 and this path passes through the path of the smoke generated in the combustion chamber of the furnace being controlled. As described in U.S. Pat. No. 3,861,855 the density of the smoke controls the amount of radiation passing through to the photoelectric cell 12 and consequently controls the generation of control signals in the electrical circuits and combustion control indicated generally at 20. Path 16 is not obscured by the smoke.

More particularly, the photoelectric cell is connected in series with a resistor taking the form of a potentiometer 22 which is connected to the photoelectric cell at a junction 24 whereat the signal is generated which is processed in the electric circuits and combustion control indicated at 20 as aforesaid.

The potentiometer 22 has a slide or wiper 26 for the manual adjustment of the arrangement. There is also provided a further potentiometer 28, the wiper of which is indicated at 30. The wiper 30 is coupled to the wiper 26 so that the potentiometer 28 constitutes a further adjustment of the resistor arrangement coupled to the photoelectric cell 12. It will be noted that the wiper 30 is mechanically coupled to a motor 32 through a mechanical linkage indicated generally at 34.

In addition to the above, there is provided still a further potentiometer indicated at 36 serving the purpose of a limit potentiometer. It includes a wiper 38 coupled via a line 40 to a clockwise and counter-clockwise control indicated generally at 42.

A comparator 44 is coupled via line 46 to junction 24. Signals derived at the junction 24 are processed in the comparator 44 and are forwarded in the form of control signals to the clockwise and counter-clockwise control 42 which is coupled via line 48 to motor 32 one end of the limit potentiometer 36 is connected to +6 volts and the other end is connected in common with an end of the potentiometer 28 to a terminal 50 set at −6 volts to supply a voltage to the potentiometers 28 and 36.

In addition to the above-noted circuitry, there is also provided a sequence timer circuit indicated generally at 54. This circuit is connected to circuits 42 via path 56 and is also connected to the shutter of arrangement 10 as indicated by path 58. The function of the circuit 54 is to control whether the photoelectric cell 12 receives light or other such radiation via path 14 or path 16 or effectively whether the photoelectric cell 12 receives light which has been partially obscured by smoke in the flue 18 or whether the photoelectric cell 12 receives light the passage of which has not been impeded in any substantial manner whatsoever.

In operation, the exciter lamp of arrangement 10 transmits light via paths 14 and 16. However, the shutter serves to block one of these paths so that the photoelectric cell 12 receives light from only one of these paths. Assuming that the light is received via path 14, this light is partially obscured by the smoke or combustion gas generated in the furnace being controlled. The photoelectric cell varies in resistance depending upon the strength of the light arriving thereat. This causes a change in the voltage divider caused to exist by the resistance of the photoelectric cell 12 and the effective resistance of the potentiometers 22 and 28. As a consequence, a signal of a certain level is generated at junction 24. Normally, this signal is transmitted to the electrical circuits and combustion control indicated at 20 and described as noted aforesaid in U.S. Pat. No. 3,861,855. This in turn causes a control of the fuel valves, dampers and air valves as has been previously described.

The sequence timer generates a cycle within which there are operating and test parts. The operating part relates to the control of the furnace by arrangement 20. The test part exists when the shutter part of arrangement 10 causes light to be transmitted to the photoelectric cell 12 via the path 16 which may be constituted as seen hereinafter, for example, by a fibre optic bundle. This light which is transmitted directly to the photoelectric cell causes the generation of a signal at the junction 24 which is transmitted via line 46 to comparator 44. Therein, this signal is compared with a standard signal such as ground or zero voltage and a control signal is derived which is transmitted to the clockwise and counter-clockwise control 42 for purposes of operating the motor 32. When the motor 32 receives a signal, it rotates in clockwise or counter-clockwise direction, thereby altering the setting of the wiper 30 on the potentiometer 28. This in turn contributes its resistance to the potentiometer 22 thereby effecting a correction of the voltage divider circuit including the photoelectric cell 12 so that the voltage divider circuit is always during each cycle corrected for any drift which may exist up to that point.

At the same time the limit potentiometer 36 has its wiper 38 adjusted by operation of the motor 32. The signal from the wiper 38 passes via line 40 to the control 42 whereat a comparison is made with maximum positive and negative voltages establishing a limit range within which adjustment is possible. When this range is exceeded, operation of the motor 32 is blocked and a visual indication is given as will be described in greater detail hereinafter.

Figure 2:
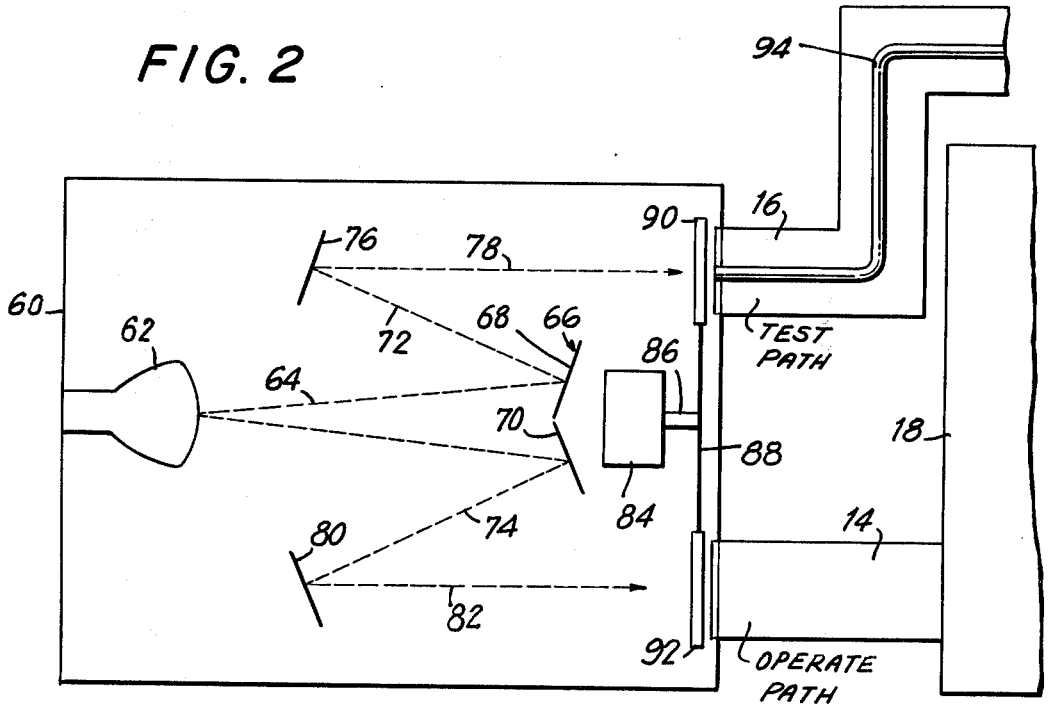
FIG. 2 diagrammatically illustrates a lamp and shutter mechanism used in the apparatus of FIG. 1.

In FIG. 2 is shown an illustrative arrangement by means of which radiation from an exciter lamp is directed along one or the other of the light paths indicated hereinabove. More particularly, within a chamber 60 is shown an exciter lamp 62 directing radiation along a path 64 against a two-piece mirror 66 having the sections 68 and 70 which respectively direct light along paths 72 and 74. The light directed along path 72 is reflected by mirror 76 to follow path 78 and thence to the test path noted hereinabove as being indicated at 16. Light which follows the path 74 is reflected by the mirror 80 to follow path 82 in an attempt to follow the "operate" path indicated hereinabove as indicated by the reference 14. One of these paths, namely the operate path tends to pass through the flue indicated at 18. Whether the light ultimately passes through path 14 or path 16 is controlled by an electro-mechanical device indicated at 84 and controlling rotation of a shaft 86 on which is mounted a rod 88 on which are supported shutters 90 and 92. The shutter 90 tends to intercept light tending to pass into the path 16 whereas the shutter 92 intercepts light tending to pass into the operative path 14.

One of the shutters 90 or 92 is effective at a time so that light passes either through the path 14 or through the path 16. As a result, this light passes through the flue 18 or passes around the flue 18. The path 16 tending to make the light circumvent the flue 18 is provided physically in the form of an optical fibre bundle indicated at 94 and constituted of an optical fibre bundle of commercially available type. It is believed unnecessary to indicate the details of such an optical fibre bundle in this text as the constitution of such bundle is well known to those of ordinary skill in the art.

The method of the invention as has been generally indicatedabove is a combustion control method. It comprises transmitting radiation through and around smoke generated by the combustion, generating control signals in a circuit in accordance with the strength of the radiation passing through said smoke, adjusting said circuit in accordance with the strength of the radiation passing around the smoke, thereby to adjust the control signals, and adjusting the combustion with the control signals. The radiation passing through or around the smoke is detected sequentially in sequential cycles. The circuit may preferably be adjusted within a limited range. When this range is exceeded, this fact is visually indicated. Steps may then be taken to manually adjust the potentiometer 22 mentioned hereinabove to establish a new range of adjustment.

Figure 3:
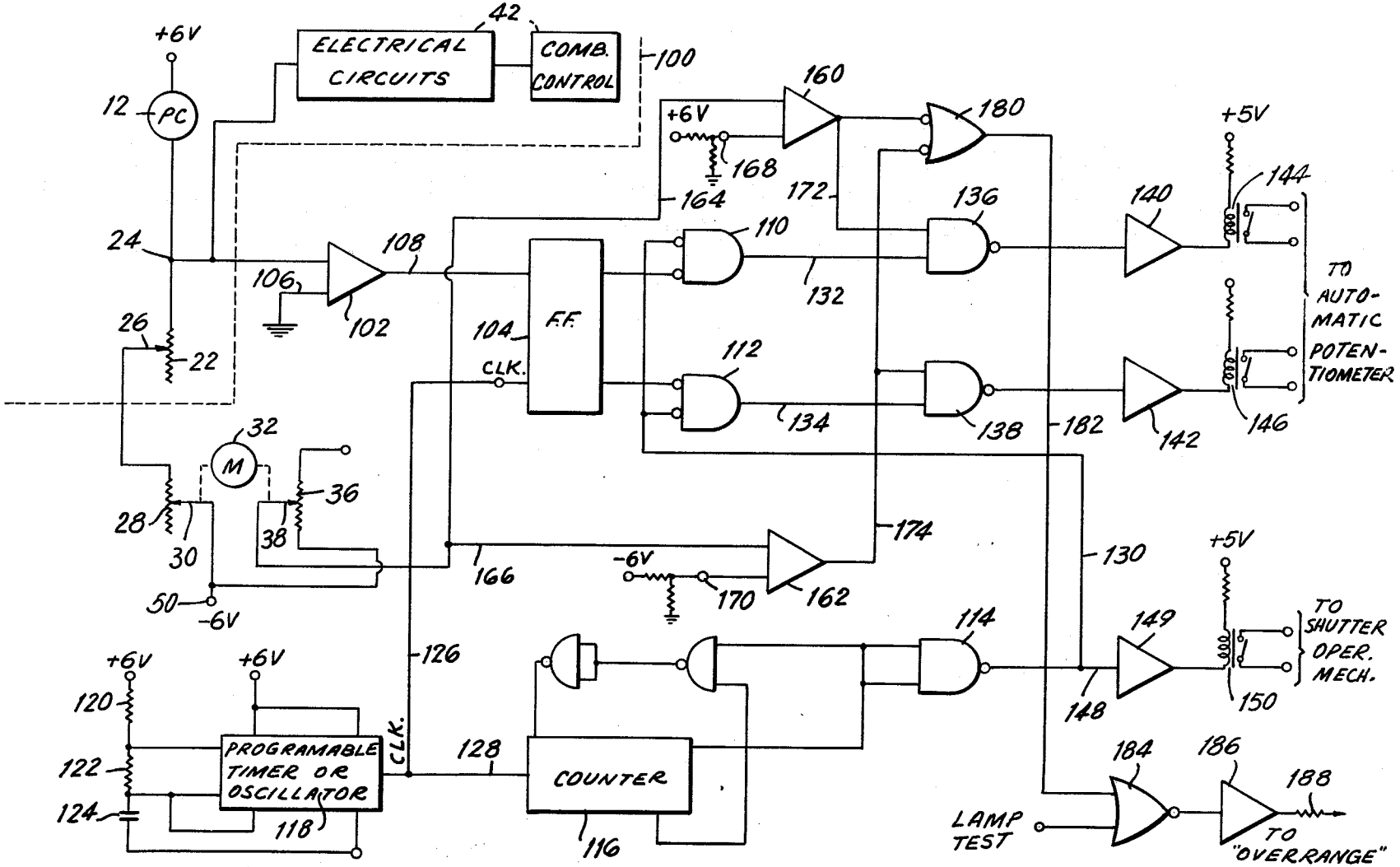
FIG. 3 is a logical circuit diagram of the comparator and automatical compensating system of FIG. 1.

FIG. 3 is a logical circuit diagram showing some of the details of the invention with greater specificivity. Therein are illustrated the photoelectric cell 12, the potentiometer 22 with its wiper 26, the junction 24 and the potentiometer 28 with the wiper 30 being controlled by the motor 32. The potentiometer 36 which serves as the limit potentiometer is also illustrated along with its wiper 38. As in FIG. 1, these potentiometers are both connected to a common terminal 50 whereat is applied a −6 volts source.

During the "operate" part of a cycle, the signal generated at a junction 24 as a result of operation of photoelectric cell 12, passes through electrical circuits and combustion control indicated hereinabove at 42 with reference to FIG. 1. The photoelectric cell 12, potentiometer 26 and circuits and control 42 are parts of the circuitry described in detail in U.S. Pat. No. 3,861,855 and are divided from the new circuitry provided in accordance with the instant invention by line 100.

The new circuitry provided in accordance with the instant invention, includes the potentiometers 28 and 36 and the various circuitry to be described hereinbelow.

More particularly, the new circuitry includes a comparator 102 feeding into a flip flop 104 such that the signal passing from the junction 24 is received in the comparator 102 whereat a determination is made as to whether the test voltage is greater than or less than zero or ground voltage which is received in the comparator 102 via line 106. The output signal of comparator 102 which is a binary one or a zero passes via line 108 to the flip flop 104 which is thereby set or not according to the signal received.

The outputs of flip flop 104 are gated through NOR gates 110 and 112, other inputs to which are passed through an inverter 114. The inverter 114 receives an input from a digital counter 116 which may be of any commercially available types, such as an integrated chip. The input to the counter 116 is provided by the programable timer or oscillator 118 which may also be constituted by any commercially available circuit, such as an integrated chip.

The circuit 118 generates a constant frequency square wave output the period of which is determined by resistors 120 and 122 and capacitor 124 which are coupled to appropriate terminals of the circuit 118. The output of the circuit 118 constitutes a reference clock pulse source transmitted via line 126 and also passes via line 128 to the counter 116 as aforesaid. The operation of the counter 116 is to count pulses generated by circuit 118 and to define the operate and test parts of the sequential cycles, all of which is set up in predetermined manner by establishing the count employed in association with counter 116 for each of these cycle portions. As has been indicated elsewhere, a typical period might be 6 seconds for the test portion and three minutes for the operate portion of each cycle. As also stated hereinabove, these values are not critical and may be widely varied.

In any event, the test cycle is indicated via line 130 feeding input terminals of the NOR gates 110 and 112 so that, during the test portion of the cycle, appropriate signals can be forwarded on via lines 132 and 134 to hand gates 136 and 138, respectively, and thence via power amplifier buffers 140 and 142 to relays indicated generally at 144 and 146. The relay 144 is the clockwise relay or electro-mechanical control, whereas the relay 146 is the counter-clockwise relay or electro-mechanicaL control. Both of these feed the motor 32 to control the clockwise or counter-clockwise direction of rotation thereof so that the wiper 30 is appropriately positioned on the potentiometer 28 to effect the necessary control of the total resistance related to junction 24 for purposes of accounting for any drift which may have occurred in the circuitry prior to junction 24 for a variety of reasons.

The inverter 114 also feeds a signal via line 148 to a power amplifier buffer 149 which feeds relay or electromechanical device 150. The relay 150 serves to operate the shutters illustrated in FIG. 2 under the control of device 84 which controls the rotation of shaft 86. Thus by the operation of the counter 116, the shutters 90 and 92 are selectively brought into alternate intercepting relationship with paths 14 and 16. Consequently, it is possible in accordance with the apparatus provided in accordance with the invention to selectively cutoff either of paths 14 or 16 to achieve the results discussed hereinabove.

In addition to the aforegoing circuitry, there are also provided comparators 160 and 162. These are range limit comparators receiving signals from the wiper 38 of limit potentiometer 36 via lines 164 and 166. Reference limit signals are applied to the comparators 160 and 162 via terminals 168 and 170. These reference limits may be, for example, in the fixed and predetermined range of plus or minus 5 volts or the like. When this range is exceeded, signals are fed via lines 172 or 174 to inverters 136 and 138 to inhibit the latter and to prevent signals from passing through. Thus, for example, when an appropriate signal is generated by comparator 160, a signal is passed to inverter 136 to inhibit the operation of relay 144. Thus, no further correction can be made in a clockwise direction. Alternatively, when an appropriate signal is generated by comparator 162, inverter 138 is inhibited and relay 146 is rendered inoperative. Thereafter, no further signals can be generated for purposes of correction in the counter-clockwise direction.

At 180 is indicated a OR gate. When a signal is passed through the OR gate 180, this indicates that comparator 160 or comparator 162 has generated a signal indicating that the limit range has been exceeded. This in turn causes a signal to be passed via line 182 to OR gate 184 which generates a signal which is passed on to amplifier 186 which signal passes via resistor 188 to an L.E.D. on a visually available panel in order to indicate visually that the range of adjustment has been exceeded. This indicates to an operator that a manual adjustment should be made relative to potentiometer 22 or other corrective steps taken in order to bring the operation of the device back to a normally operating range. Such corrective steps might include, for example, cleaning off the face of the photoelectric cell or changing the exciter lamp and replacing it with a new one having a full brightness. to above ground.

From what has been stated above, it will now be obvious that there is provided in accordance with the invention a combustion control apparatus comprising combustion means producing smoke incidental to the burning of fuel as described in U.S. Pat. No. 3,861,855, combustion control means for controlling combustion in said combustion means as a result of which the density of said smoke is varied, smoke exhaust means defining a path along which said smoke is evacuated, adjustable electrical circuit means for operating said control means, a radiation source, detection means for detecting said radiation and further means for guiding said radiation through and around the path along which said smoke is evacuated and for adjusting said electrical circuit means to provide a continuously adjustable reference against which measurements of smoke density are made for controlling said combustion, the measurements of smoke density being made by said detection means in accordance with the radiation being guided through said path and the adjustable reference being provided in accordance with the radiation being guided around said path.

There will now be obvious to those skilled in the art many modifications and variations of the circuitry and apparatus disclosed hereinabove. These modifications and variations will not depart from the scope of the invention if defined in the following claims.

What is claimed is:

1. Combustion control apparatus comprising combustion means producing smoke incidental to the burning of fuel, combustion control means for controlling combustion in said combustion means as a result of which the density of said smoke is varied, smoke exhaust means defining a path along which said smoke is evacuated, adjustable electrical circuit means for operating said control means, a radiation source, detection means for detecting said radiation, and further means for guiding said radiation through and around the path along which said smoke is evacuated and for adjusting said electrical circuit means to provide a continuously adjustable reference against which measurements of smoke density are made for controlling said combustion, the measurements of smoke density being made by said detection means in accordance with the radiation being guided through said path and the adjustable reference being provided in accordance with the radiation being guided around said path.

2. Apparatus as claimed in claim 1 wherein said further means includes means for cyclically enabling said detection means to detect, alternately, radiation guided through and around said path.

3. Apparatus as claimed in claim 1 comprising means for amplifying the density of the smoke through which the radiation is guided.

4. Apparatus as claimed in claim 1 comprising means for indicating when a range of adjustment of said reference has been exceeded.

5. Apparatus as claimed in claim 1 wherein said radiation source is a source of light and said detection means is a photoelectric means, and said further means includes an optical fibre bundle for guiding the radiation around said path.

6. Apparatus as claimed in claim 1 wherein said electrical circuit means includes a potentiometer coupled to said detection means and said further means includes a potentiometer coupled to the first said potentiometer and electro-mechanical means for operating the second said potentiometer.

7. Apparatus as claimed in claim 1 wherein said further means includes shutter means for selectively and alternately intercepting the radiation guided through and around said path so that said detection means responds alternately to radiation guided through or around said path.

8. Apparatus as claimed in claim 6 wherein said further means includes shutter means for selectively and alternately intercepting the radiation guided through and around said path so that said detection means responds alternately to radiation guided through or around said path.

9. Apparatus as claimed in claim 8 wherein said further means includes sequence timer means alternately generating operating and test periods and controlling said shutter means.

10. Apparatus as claimed in claim 1 wherein said further means includes fibre optic means between said radiation source and detection means for guiding said radiation around said path.

11. Apparatus as claimed in claim 1 wherein said further means includes means between said radiation source and detection means for guiding said radiation around said path.

12. Apparatus as claimed in claim 11 comprising mirror means adjacent said source and guiding part of the radiation to said fibre optic means and part of the radiation through said path.

13. Apparatus as claimed in claim 9 wherein said sequence timer means includes a pulse generator, a counter coupled to said generator for counting pulses, and gating means coupled to said counter for indicating operating and test periods.

14. Apparatus as claimed in claim 6 comprising a junction between said detection means and the first said potentiometer, said further means including comparator means comparing the voltage at said junction with a reference voltage and generating digital signals indicating whether the voltage at said junction is greater or less than said reference voltage.

15. Apparatus as claimed in claim 14 comprising flip flop controlled by said comparator means, and controls coupled to said flip flop and operated thereby to cause said electro-mechanical means to operate selectively in opposite directions.

16. Apparatus as claimed in claim 6 wherein further means includes a further potentiometer including a wiper, said electro-mechanical means driving said wiper, and comparator means for comparing voltages derived by said wiper with range limit voltages to determine when the latter have been exceeded.

17. Apparatus as claimed in claim 15 wherein said further means includes a further potentiometer including a wiper, said electro-mechanical means driving said wiper, and comparator means for comparing voltages derived by said wiper with range limit voltages to determine when the latter have been exceeded, the latter said comparator means operating to block said electro-mechanical means.

18. A combustion control method comprising transmitting radiation through and around smoke generated by said combustion, generating control signals in a circuit in accordance with the strength of the radiation passing through said smoke, adjusting said circuit in accordance with the strength of the radiation passing around the smoke thereby to adjust the control signals, and adjusting the combustion with the control signals.

19. A method as claimed in claim 18 wherein the radiation passing through and around the smoke is detected sequentially in sequential cycles.

20. A method as claimed in claim 19 wherein the circuit is adjusted within a limited range.

* * * * *